United States Patent [19]

Kashimoto et al.

[11] 4,446,346

[45] May 1, 1984

[54] VACUUM INTERRUPTER

[75] Inventors: Yutaka Kashimoto, Tokyo; Shinzo Sakuma, Kanagawa; Eiji Umeya, Shizuoka, all of Japan

[73] Assignee: Kabushiki Kaisha Meidensha, Tokyo, Japan

[21] Appl. No.: 310,397

[22] Filed: Oct. 9, 1981

[30] Foreign Application Priority Data

Oct. 21, 1980 [JP] Japan ..... 55-150277[U]

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,182,156 | 5/1965 | Lee et al. | 200/144 B |
| 3,462,572 | 8/1969 | Sofianek | 200/144 B |
| 3,522,399 | 7/1970 | Crouch | 200/144 B |
| 3,576,960 | 3/1978 | Kurtz | 200/144 B |
| 3,727,018 | 4/1973 | Wesoloski et al. | 200/144 B |
| 3,809,836 | 5/1974 | Crouch | 200/144 B |

FOREIGN PATENT DOCUMENTS

| | | | |
|---|---|---|---|
| 134897 | 3/1979 | Fed. Rep. of Germany | 200/144 B |

*Primary Examiner*—Robert S. Macon

*Attorney, Agent, or Firm*—Schwartz, Jeffery, Schwaab, Mack, Blumenthal & Koch

[57] ABSTRACT

A vacuum interrupter comprising a pair of fixed and movable electrode rods having a flange portion identical shape, a pair of fixed and movable electrodes of the magnetic arc driving type having a central hole and two annular recessed fitting portions of identical depth on the upper and lower surfaces thereof, respectively, and a contact member having a flange portion; the annular recessed fitting portions of the electrodes being formed to match the flange portion of the electrode rod and also with the flange portion of the contact member so that a single form of electrode rods and a single form of electrodes can be used in common in cooperation with the contact member, and the number of elements and the manufacturing cost can be reduced when two different material contacts are used for prevention of fusion sticking.

6 Claims, 8 Drawing Figures

VACUUM INTERRUPTER

BACKGROUND OF THE INVENTION

1. Field of the Invention

The present invention relates generally to a vacuum interrupter, and more specifically to a pair of electrodes of the magnetic arc driving type used for the vacuum interrupter.

2. Description of the Prior Art

In a vacuum interrupter, special structures have been devised for a pair of electrodes in order to improve the performance of current interruption. One of the examples of these structures is a pair of electrodes of the magnetic arc driving type.

In a vacuum interrupter provided with a pair of electrodes of the magnetic arc driving type within the vacuum vessel, each electrode is formed roughly in a disk shape having a circular recessed portion at the center of one surface thereof, a circular contact surface formed on the same surfce thereof concentric with the circular recessed portion, and a number of separate arc-driving members extending from the peripheral edges thereof to the center thereof in a straight line or a spiral form around the contact surface thereof.

In a pair of conventional electrodes of the magnetic arc driving type used with the vacuum interrupter, the arc-driving members are radially symmetrical with respect to the center of the electrode in order to effectively drive the arc, generated whenever the electrodes are closed or opened, outwardly, and two types of electrodes having two different shapes opposite to each other with respect to the cross section are used for the movable electrode and fixed electrode, independently.

Accordingly, in order to manufacture these electrodes of the magnetic arc driving type by using, for example, forging steps, two kinds of different metal forging dies must be prepared for the reason explained above, thus increasing the number of manufacturing steps and the manufacturing cost.

Further, in the vacuum interrupter, since two different material contacts are usually used in order to prevent fusion sticking between the fixed and movable contacts, it is necessary to prepare two kinds of contacts in addition to a pair of fixed and movable electrode rods and a pair of fixed and movable electrodes of the magnetic arc driving type, thus increasing the number of elements and thereby the manufacturing cost.

A more detailed description of the electrodes of magnetic arc driving type will be made with reference to the attached drawings under DETAILED DESCRIPTION OF THE PREFERRED EMBODIMENTS.

SUMMARY OF THE INVENTION

With these problems in mind therefore, it is the primary object of the present invention to provide a vacuum interrupter provided with a pair of electrodes of the magnetic arc driving type, in which a single, form can be used for the fixed and movable electrodes, so that it is possible to reduce the number of metal forging dies, manufacturing steps, and manufacturing cost and in which the contact portion thereof can be manufactured using as few elements as possible when two different materials are used for the contacts.

To achieve the above-mentioned object, the vacuum interrupter according to the present invention comprises a pair of electrodes both the electrode surfaces of which are formed symmetrically with respect to the central axis in the cross section thereof with the same cross section and the same shape and which are provided with a number of arc driving members to drive the arc generated between the electrodes. The vacuum interrupter according to the present invention comprises a pair of fixed and movable electrode rods, a pair of fixed and movable electrodes of the magnetic arc driving type and an additional contact member in such a manner that a single form of electrode rods and a single form of electrodes can be used in common in cooperation with the additional contact member, so that it is possible to reduce the number of elements and the manufacturing cost. Each of the fixed and movable electrode rods is formed with a flange portion at one end thereof; each of the fixed and movable electrodes of the magnetic arc driving type is formed with central hole and two annular equal-depth recessed fitting portions on the upper and lower surfaces thereof, the flange portion of each of the fixed and movable electrode rods being fitted to one of the two annular recessed fitting portions of each of the fixed and movable electrodes, respectively; and the contact member is formed with a flange portion fitted to the other of the two annular recessed fitting portions of one of the two fixed and movable electrodes in such a way that the flange portion of the electrode rod fixed to the other of said electrodes can be brought into contact with or separated from the contact member for current interruption.

BRIEF DESCRIPTION OF THE DRAWINGS

The features and advantages of the vacuum interrupter according to the present invention will be more clearly appreciated from the following description taken in conjunction with the accompanying drawings in which like reference numerals designate corresponding elements and in which.

DETAILED DESCRIPTION OF THE PREFERRED EMBODIMENTS

Figure 1A:
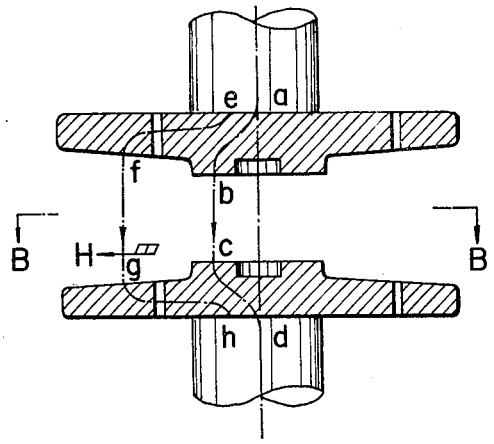
FIG. 1(A) PRIOR ART
FIG. 1(A) is a cross sectional view of a pair of prior-art electrodes of the magnetic arc driving type.

To facilitate understanding of the present invention, a brief discussion will be given hereinafter of pair of prior-art electrodes of the magnetic arc driving type used for a vacuum interrupter, with reference to FIGS. 1(A) and (B).

In vacuum interrupters of the magnetic arc driving type, as the rated breaking current increases, and therefore the diameter of the electrodes increases, the arc generated between the electrodes becomes less uniformly distributed across the electrode surfaces, and is usually concentrated partially on some portion of the electrode surfaces. Particularly at the corner portion of the electrode, the metal is subject to evaporation, thus ensuring that the arc generated between the electrodes stays at this portion. Therefore, the surface of the electrode melts markedly, thus resulting in localization of subsequent arcs, lowering the electrical withstanding voltage, and then reignition or restriking occurs between a pair of electrodes.

The magnetic arc driving method is one attempt to prevent partial melting of the electrodes by applying a magnetic field in the lateral direction of the arc to drive the arc outwardly from the arc generation position depending upon a force measured by multiplication of current by magnetic flux density ($I \times B$). The typical electrode is a spiral electrode as depicted in FIGS. 1(A) and (B), in which a pair of prior-art spiral electrodes of magnetic arc driving type are shown in a cross-sectional view and a top view.

Figure 1B:
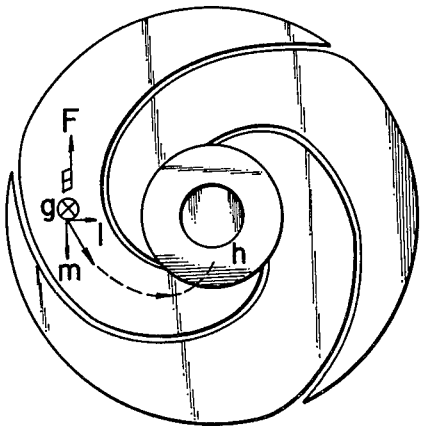
FIG. 1(B) PRIOR ART
FIG. 1(B) is a top view of a pair of prior-art electrodes of the magnetic arc driving type in the direction shown by the arrows B—B in FIG. 1.

In these figures, the arc (b-c) generated first at the contact portion of the electrodes is driven outwardly by the influence of the magnetic field produced by the current through the parts (a-b) and (c-d). Next, when taking into account the case where the arc (b-c) moves to the position (f-g), since a number of spiral slits are provided in the electrode surface, the current flowing through the electrode (g-h) flows in a spiral route on the arc driving member of the electrode as depicted by the dashed line of FIG. 1(B). Accordingly, this current can be divided into two components of m (circumferential direction) and l (radial direction). The current component m in this circumferential direction generates a magnetic field in the H-direction of FIG. 1(A), and the arc is driven in the circumferential direction, that is, in the F-direction of FIG. 1(B) by the mutual operation of this magnetic field H and the arc (g-f). Since the arc is driven in the circumferential direction along the electrode surface, partial heating can be minimized on the electrode surface, thus increasing the upper limit of current interruption. It is possible to explain the movement due to the current (e-f) in the radial direction analogously to the current (g-h).

In a pair of conventional electrodes of the magnetic arc driving type used with the vacuum interrupter, however, although the arc driving members are formed symmetrically with respect to the center of the electrode to effectively drive the arc, generated whenever the electrodes are closed or opened, outwardly, two types of electrodes the electrode surfaces of which are independently formed symmetricaly with respect to the central axis thereof, are used for the fixed and movable electrodes in a single vacuum interrupter. Accordingly, in order to manufacture these electrodes of the magnetic arc driving type by using, for example, forging steps, two kinds of different metal forging dies must be prepared, thus increasing the number of members and manufacturing steps and the manufacturing cost.

In view of the above description, reference is now made to FIGS. 2 to 7, and more specifically to FIG. 2, in which a preferred embodiment of the vacuum interrupter according to the present invention is illustrated by way of example with a pair of electrodes of the magnetic arc driving type improved as described in more detail hereinafter.

Figure 2:
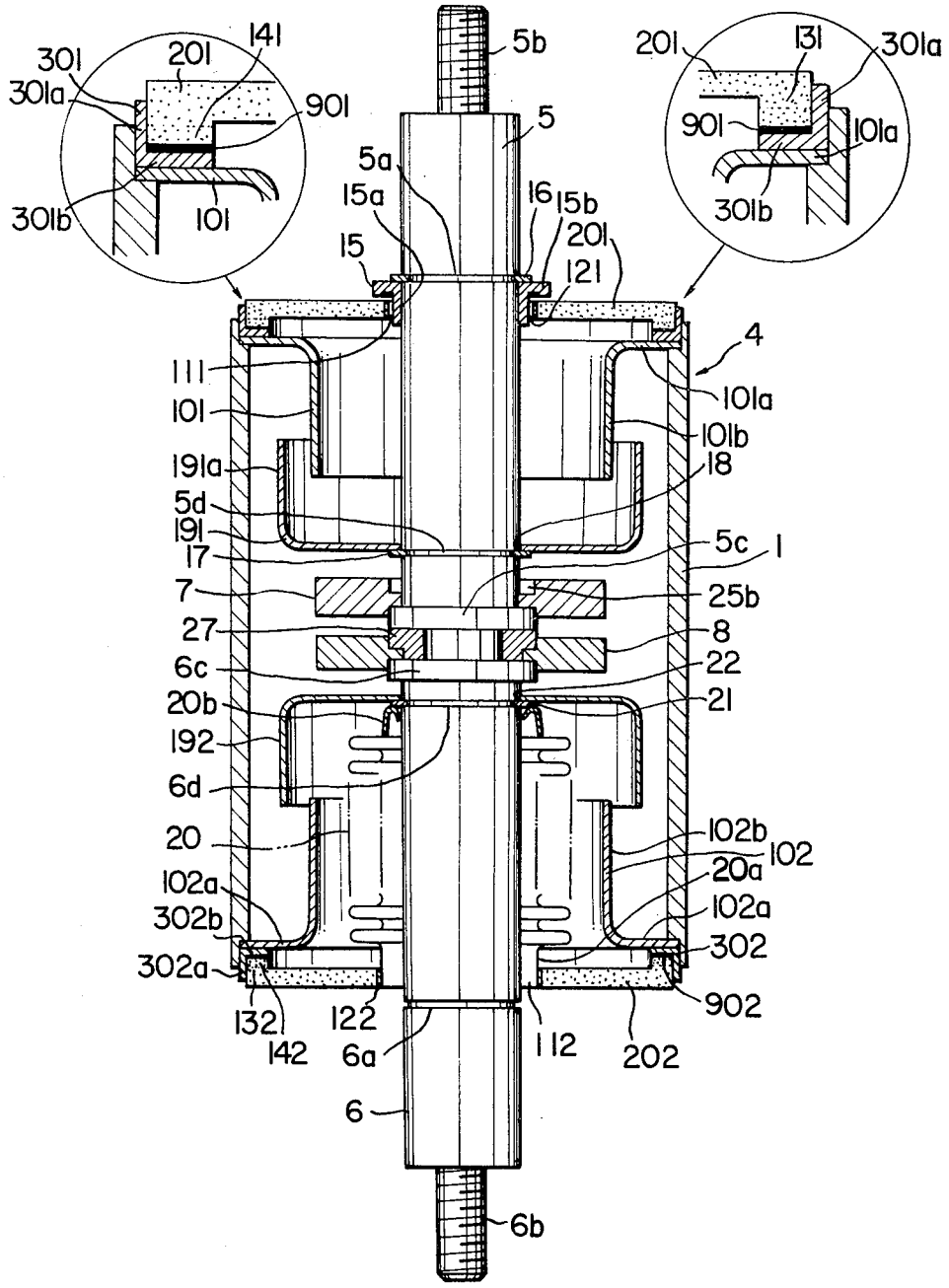
FIG. 2 is a longitudinal cross-sectional view of a preferred embodiment of the vacuum interrupter according to the present invention.

With reference to FIG. 2, there is explained hereinbelow the structure of the vacuum interrupter according to the present invention.

In this interrupter, a pair of end plates comprising fixed-side end plate 201 and movable-side end plate 202 made of inorganic insulating material are hermetically joined to both the ends of a cylindrical metal housing 1 with a pair of auxiliary sealing members 301 and 302 having an L-shaped cross section hermetically disposed therebetween in order to form a vacuum vessel 4 usable under a high vacuum.

Within this vacuum vessel 4, a pair of electrode rods, comprising one fixed rod 5 and one movable rod 6, are inserted through the central portions of the fixed-side end plate 201 and the movable-side end plate 202, respectively, along the axial direction of the vacuum vessel 4 (vertical direction in FIG. 2).

To the respective inside ends of the fixed electrode rod 5 and movable electrode rod 6, a pair of electrodes fixed electrode 7 and movable electrode 8 of the magnetic arc driving type are secured, respectively.

The cylindrical metal housing 1, constituting a part of the vacuum vessel 4, is made of, for instance, austenitic stainless steel, copper, or iron. Metallized portions 901 and 902 are formed on the inner peripheral portions of the fixed-side end plate 201 and the movable-side end plate 202 respectively.

In addition, a pair of disc-shaped auxiliary sealing members 301 and 302 having an L-shaped cross-section, each of which includes a cylindrical portion **301*a* or 302*a* extending in the axial direction thereof (vertical direction in FIG. 2) and a flange portion 301*b* or 302*b* extending in the radial direction thereof (horizontal direction in FIG. 2) perpendicular to the cylindrical portion 301*a* or 302*a*, respectively, are fitted and hermetically joined by brazing in such a way that a cylindrical portion 301*a* or 302*a* is in contact with each metallized portion 901 or 902 of each end plate 201 or 202 and a flange portion 301*b* or 302*b* is in contact with each flange portion 101*a* or 102*a* of the fixed-side and movable-side auxiliary shields 101 and 102**.

Each auxiliary sealing member 301 or 302 is used for improving the reliability of the hermetic seal between the cylindrical metal housing 1 and the fixed-side end plate 201 and the movable-side end plate 202, because the thermal expansion coefficients of these two materials differ. The auxiliary sealing members 301 and 302 are made of a relatively soft material such as copper, and therefore are deformable to reduce the thermal stress generated between the cylindrical metal cylinder housing and the fixed-side and movable-side end plates when these two members are brazed to each other and cooled after brazing. However, the auxiliary sealing members are not limited to copper. It is also possible to use iron, a Fe-Ni-Co alloy, or a Fe-Ni alloy for the material of the auxiliary sealing members 301 and 302.

In this embodiment, the fixed-side and movable-side end plates are made of inorganic insulation material such as alumina ceramics or crystallized glass, and are formed into a disk shape each having a hole 111 or 112 at the center thereof.

Near each inner surface of each hole 111 or 112, metallized layers 121 and 122 are formed. Similarly to the above-mentioned metallized layers 901 and 902, metallized layers 121 and 122 are formed of a Mn-Ti alloy or a Mo-Mn-Ti alloy, the thermal expansion coefficient of which is roughly the same as that of the fixed-side and movable-side end plates for protection of bonding strength therebetween.

In addition, a plurality of annular projection portions 141 or 142 with a 0.1–0.5 mm height respectively are formed on each circumferential portion 131 or 132 of each fixed-side or movable-side end plate 201 or 202. Further, the invention is not limited to the case where the fixed-side and movable-side end plates 201 and 202 are hermetically joined to either end of the cylindrical metal housing 1 through auxiliary sealing members 301 and 302. It is also possible to form the vacuum vessel 4 by hermetically sealing an insulator cylinder housing with a pair of metal end plates by using a pair of sealing metal members fixed on either end of the insulator cylinder housing.

A ring-shaped auxiliary sealing member 15 with a L-shaped cross section, which includes a cylindrical portion 15*a* extending in the axial direction thereof (vertical direction in FIG. 2) and a flange portion 15*b* extending in the radial direction thereof (horizontal direction in FIG. 2) is fitted and hermetically joined to the hole 111 of the fixed-side end plate 201 in such a way that the flange portion 15*b* is in contact with the central portion of the outside surface of the fixed-side end plate 201 and the cylindrical portion 15*a* is almost in contact with the hole 111 of the fixed-side end plate 201.

Within the vacuum vessel 4, the fixed electrode rod 5 made of copper or a copper alloy is inserted through the disc-shaped auxiliary sealing member 15 fitted to the hole 111 formed in the fixed-side end plate 201. During assembly, movement of the fixed electrode rod 5 in the axial direction thereof is restricted when a first retainer 16 fitted to a peripheral groove 5*a* provided around an outer portion of the fixed electrode rod 5 is brought into contact with the outer surface of the disc-shaped auxiliary sealing member 15, and the fixed electrode rod 5 is then hermetically joined by brazing to the cylindrical portion 15*a* of the disc-shaped auxiliary sealing member 15.

In the same way as with the disc-shaped auxiliary sealing member 301 disposed between the cylindrical metal housing 1 and the fixed-side end plate 201, the ring-shaped auxiliary sealing member 15 is used for joining the insulator end plate 2 to the fixed electrode rod 5 with a source seal in spite of the fact that there is a difference in thermal expansion coefficient between the fixed-side end plate 201 and the fixed electrode rod 5, the ring-shaped auxiliary sealing member 15 being made of the same metal as the disc-shaped auxiliary sealing member 301.

Also, a threaded portion 5*b* is provided at the top end portion of the fixed electrode rod 5, and a flange portion 5*c* integrally formed with the rod is provided at the bottom end portion of the fixed electrode rod 5 so as to form a current contact area when brought into contact with a fixed electrode 7 described hereinafter.

Near the flange portion 5*c*, another peripheral groove 5*d* is formed, into which a second retainer 17 is fitted. A fixed-side main arc-shield 191 formed in a cup-shape having a diameter larger than that of the auxiliary shield 101 is fitted to the second retainer 17 and fixed by brazing so as to restrict the movement of the shield in the axial direction thereof.

The cylindrical portion 191*a* of the fixed-side main arc-shield 191 opens upward facing the auxiliary shield 101 and serves to make uniform the distribution of the electric field within the vacuum vessel 4 in cooperation with the auxiliary shield 101 provided on the fixed-side and additionally to prevent metal vapour from depositing onto the inner surface of the fixed-side end plate 201. For this purpose, the fixed-side auxiliary shield 101 and fixed-side main arc shield 191 overlap each other concentrically.

An austenitic stainless steel bellows 20 housed concentrically within the vacuum vessel 4 is attached to a hole 112 in movable-side end plate 202 by way of a cylindrical portion 20*a* formed by extending the inner diameter of the outer end thereof in the axial direction and hermetically joined by brazing to the metallized layer 122.

Also, at the inner end portion of the bellows 20, there is provided a mounting portion 20*b* with a V-shaped cross section formed by extending the inner diameter of the inner end of the bellows in the axial direction and by bending the extended portion toward the axis of the vacuum vessel 4.

Within the vacuum vessel 4, the movable electrode rod 6, which is formed into almost the same shape as that of the fixed electrode rod 5, is inserted through the central hole 112 and the bellows 20. Movable electrode rod 6 is made of the same metal as the fixed electrode rod 5 and has a peripheral groove 6*a* on an outer portion thereof, a threaded portion 6*b* at the outer end thereof in order to connect a vacuum interrupter operating device (not shown), a flange portion 6*c* at the inner end thereof as a current contact area integrally formed therewith, and another peripheral groove 6*d* near the flange portion 6*c*. During assembly, the movement of the movable electrode rod 6 in the axial direction thereof is restricted by a third retainer 21 fitted to the peripheral groove 6*d* provided near the inner end portion of the movable electrode rod 6 in conjunction with the mounting portion 20*b* of the bellows 20, and the movable electrode rod 6 is hermetically joined by brazing to the mounting portion 20*b* of the bellows 20.

The movable-side main arc-shield 192 is attached between the flange portion 6*c* of the movable electrode rod 6 and the peripheral groove 6*d* provided near the flange portion 6*c* and is formed into a cup shape having a larger diameter than that of the fixed-side auxiliary shield 101 one the fixed-side end plate side.

The main arc-shield 192 opens downwardly facing the movable-side auxiliary shield 102, and also serves to make uniform the distribution of the electric field within the vacuum vessel 4 in cooperation with the the movable-side auxiliary shield 102 provided on the lower side and additionally to prevent metal vapour from depositing onto the bellows 20 and the inner surface of the movable-side end plate 202. For this purpose, the main arc-shield 192 and auxiliary shield 102 overlap each other concentrically.

Figure 3:
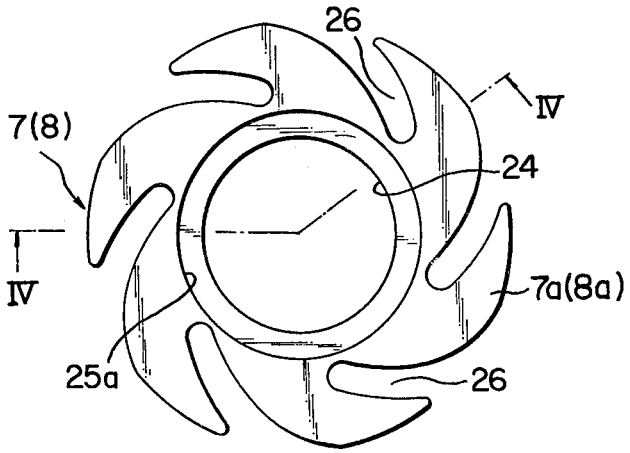
FIG. 3 is a top view of a first preferred embodiment of the electrode of the magnetic arc driving type used with the vacuum interrupter according to the present invention.
Figure 4:
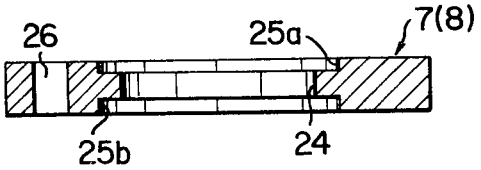
FIG. 4 is a cross-sectional view taken along the lines IV—IV of FIG. 3.

As shown in FIG. 2, at the inner end portions of the above-mentioned fixed electrode rod 5 and movable electrode rod 6, a pair of electrodes comprising a fixed electrode 7 and movable electrode 8 of the magnetic arc driving type are mounted. In the fixed and movable electrodes 7 and 8, both electrode surfaces are symmetrical, and the electrodes 7 and 8 have identical shapes and identical cross-sections. More specifically, as shown in FIGS. 3 and 4, each electrode 7 and 8 is of a roughly disc shape and is provided with a through hole 24 at the center thereof in the axial direction (vertical direction in FIG. 4). The diameter of the hole 24 is almost the same as that of each electrode rod 5 or 6.

Adjacent the hole 24 in both the electrode surfaces, two recessed fitting portions 25*a* and 25*b* are provided having almost the same diameter as that of the flange portion 5*c* or 6*c* of each electrode rod 5 or 6, respectively.

The recessed fitting portions 25*a* and 25*b* serve to mount the electrodes 7 and 8 onto the electrode rods 5 and 6, respectively.

Further, in each electrode 7 and 8, a plurality of arc driving members 7*a* formed by slits starting from a plurality of positions on the outer peripheral portion thereof and leading to near the recessed fitting portions 25*a* and 25*b* with approximately the same spacing throughout are provided in order to drive the arc, generated when the electrodes are closed or opened, outwardly.

The fixed electrode 7 is fitted to the fixed electrode rod 5 through the hole 24, and either of the recessed fitting portion 25*a* or 25*b* is fitted and fixed to the proximal face of flange portion 5*c* of the fixed electrode rod 5.

On the other hand, the movable electrode 8 is fitted and fixed to the distal face of flange portion 6*c* of the movable electrode rod 6 with either of the recessed fitting portion 25*a* or 25*b* being brought into contact with the flange portion 6*c* of the movable electrode rod 6.

To the other recessed fitting portion 25*b* or 25*a* of the movable electrode 8, a ring-shaped contact member 27 formed with an L-shaped cross section, which includes a cylinder portion extending in the axial direction thereof and having almost the same diameter as that of the hole 24 of the movable electrode 8 and a flange portion extending in the radial direction and having almost the same diameter as that of the recessed fitting portion 25*b* or 25*a*, is fitted and fixed by brazing, as shown in FIG. 2, in such a way that its cylindrical portion and some part of its flange portion respectively are fitted to the hole 24 and the recessed fitting portion 25*b* or 25*a* of the movable electrode 8. As can be seen from the drawing, the face of contact member 27 contacts the distal face of flange portion 5*c* of fixed electrode rod 5.

Furthermore, the contact member 27 is made of a material having a high antiweld property such as a Cu-Bi alloy in order to improve the welds of the fixed and movable electrodes 7 and 8. However, contact member 27 is not limited to this material, and it is of course possible to form at least one of the flange portions 5*c* and 6*c* of the fixed electrode 5 and movable electrode 6, respectively, of a material having a high antiweld property.

In this embodiment, the flange 5*c* and the contact member 27 serve to drive the arc by the arc driving members 7*a* of the electrodes 7 and 8, as described with reference to FIG. 1.

Figure 5:
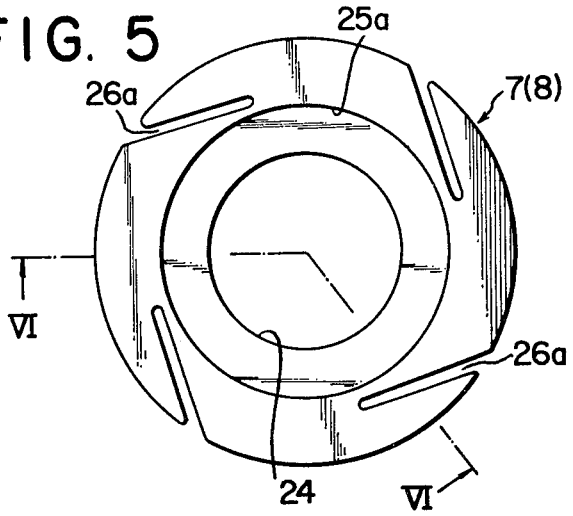
FIG. 5 is a top view of a second preferred embodiment of the electrode of the magnetic arc driving type used with the vacuum interrupter according to the present invention.
Figure 6:
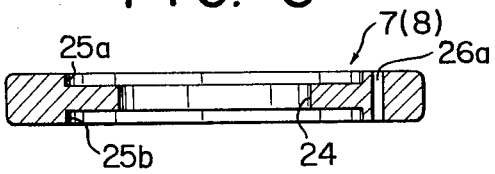
FIG. 6 is a cross-sectional view taken along the lines VI—VI of FIG. 5.

In the above-described embodiment of the vacuum interrupter, although the slits 26 provided in the fixed and movable electrodes 7 and 8 are illustrated in the form of a spiral, it is possible to use slits of other forms, such as shown in FIGS. 5 and 6, which start from a plurality of positions around the circumference of the electrode and lead to near the recessed fitting portions 25*a* and 25*b* in a straight line, maintaining approximately the same spacing.

In addition, it is possible to provide slits 26 in the electrodes at an appropriate predetermined angle with respect to the axis of the electrode (vertical direction in FIG. 4).

Figure 7:
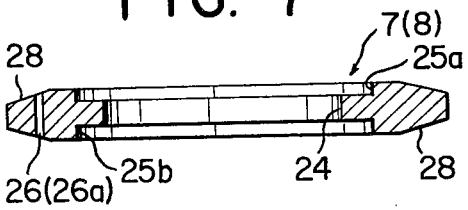
FIG. 7 is a cross-sectional view of a third preferred embodiment of the electrode of the magnetic arc driving type used with the vacuum interrupter according to the present invention.

Further, the arc-driving members 7*a* and 8*a* of the fixed electrode 7 and the movable electrode 8 can be formed in a disc shape having a tapered periphery 28 in vertical cross-section in which the electrode thickness decreases toward the outer diameter, as shown in FIG. 7.

As described above, in a vacuum interrupter having a pair of disc-shaped electrodes of the magnetic arc driving type disposed within the vacuum vessel so as to be brought into contact with or separated from each other for current interruption, since the pair of magnetic arc driving type electrodes are formed symmetrically with respect to the cross section perpendicular to the axial direction thereof, that is, along the arc-running direction, it is possible to use only one kind of magnetic arc driving electrode in the vacuum interrupter. Therefore, the electrodes can be manufactured in mass production steps by using only a single forging metal die, thus reducing the number of manufacturing steps and the manufacturing cost markedly. Also, since a single form of electrode rods and a single form of electrodes of the magnetic arc driving type can be used in common in cooperation with the additional contact member, it is possible to reduce the number of elements and further reduce the manufacturing cost.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A vacuum interrupter comprising:

(a) a pair of fixed and movable electrode rods, each of said electrode rods being formed with a flange portion at one end thereof;

(b) a pair of fixed and movable electrodes of the magnetic arc driving type, each of said electrodes being formed with a central hole and two annular equal-depth recessed fitting portions on the upper and lower surfaces thereof, said flange portion of each of said fixed and movable electrode rods being fitted to one of said two central recessed fitting portions of each of said fixed and movable electrodes, respectively; and (c) a contact member formed with a flange portion fitted to the other of said two annular recessed fitting portions of one of said two electrodes in such a way that the flange portion of the electrode rod fixed to the other electrode can be brought into contact with or separated from said contact member for current interruption.

2. A vacuum interrupter as set forth in claim 1, wherein a plurality of slits in said fixed and movable electrodes start from a plurality of positions along the circumference thereof and lead to near the recessed fitting portions in a straight line form while maintaining approximately the same spacing.

3. A vacuum interrupter as set forth in claim 1, wherein said contact member has an antiwelding property higher than that of said fixed and movable electrodes.

4. A vacuum interrupter as set forth in claim 3, wherein said contact member is made of a Cu-Bi alloy.

5. A vacuum interrupter as set forth in claim 1, wherein one of the annular recessed fitting portions of said one electrode is fixed to the distal face of the flange portion of one of said electrode rods; said contact member being fitted to the other annular recessed fitting portion of said one electrode, and one of the annular recessed fitting portions of the other electrode is fixed to the proximal face of the flange portion of the other of said electrode rods.

6. A vacuum interrupter as set forth in claim 1, wherein said contact member is fitted to an annular recessed fitting portion of the movable electrode and can be brought into contact with the distal face of the flange portion of the fixed electrode rod.

* * * * *